US007441286B1

(12) United States Patent
Taylor Parker

(10) Patent No.: US 7,441,286 B1
(45) Date of Patent: Oct. 28, 2008

(54) PORTABLE UTILITY SINK

(75) Inventor: Alice Lenora Taylor Parker, Pennsauken, NJ (US)

(73) Assignee: Alice Lenora Parker, Pennsauken, NJ (US)

( * ) Notice: Subject to any disclaimer, the term of this patent is extended or adjusted under 35 U.S.C. 154(b) by 445 days.

(21) Appl. No.: 11/287,772

(22) Filed: Nov. 28, 2005

Related U.S. Application Data

(60) Provisional application No. 60/631,606, filed on Nov. 29, 2004.

(51) Int. Cl.
*A47K 1/00* (2006.01)

(52) U.S. Cl. ..... 4/625; 280/652

(58) Field of Classification Search ..... 4/625–626, 4/630; 280/37, 639, 652
See application file for complete search history.

(56) References Cited

U.S. PATENT DOCUMENTS 2,920,900 A * 1/1960 Best ..... 280/652
4,998,302 A * 3/1991 Silva ..... 4/516
5,465,438 A * 11/1995 Allman et al. ..... 4/626
5,918,323 A * 7/1999 Smith ..... 4/262

* cited by examiner

*Primary Examiner*—Charles E Phillips

(57) ABSTRACT

A portable utility sink with a cart that is collapsible for easy transport in a car. A detachable sink that sits on top of the cart when open. The faucet has the fresh water container attached above to allow for a downward flow of water that makes this sink powerless. The garden hose as a water source when stationary a location that has optional connection ability. The back wheels are for moving the cart. The crossbar is for support of the cart. The retractable handle is for leverage to move, open, close and to fold the cart. The utility sink cart becomes collapsible by pivoting the handle with legs to fold up in a vertical dimension. The pulling of the upward motin starts to collapse reduce in breadth and width. The action is reversed to open.

5 Claims, 4 Drawing Sheets

PORTABLE UTILITY SINK

CROSS-REFERENCE TO RELATED APPLICATIONS

This application claims the benefit of provisional patent application Ser. No. 60/631,606, filed Nov. 29, 2004 by the present inventor.

FEDERALLY SPONSORED RESEARCH

Not Applicable

SEQUENCE LISTING OR PROGRAM

Not Applicable

BACKGROUND OF THE INVENTION

1. Field of Invention

This invention relates to a portable utility sink whose versatility, convince to many outdoor functions and is powerless and environmentally safe.

2. Prior Art

The prior art of portable sinks has not addressed the issue of use in natural disasters for individuals, families, to transport personal belongings such as clothing, food, first aid and water to a safe haven, when affected by any loss. This invention solves the problem by providing for transporting goods and the use of a sink.

Another objective is that none of the prior art can disassemble as easily and does not provide a simple carry and storage method for the sink. The carry bag for the Parker invention allows all the sink parts to fit inside of the bowl of the sink with a bowl cover lid for easy transport. The carry bag can be made of mesh, leather or vinyl for durability and support through various weather conditions. There is also an attached soap dispenser pocket on the bag.

U.S. Pat. Nos. 6,101,643, 5,813,063, 6,173,458 B1 and 2003/0019031 A1 these prior inventions all depend on electricity for power to be effective. With the Parker invention you never need to worry about a power outage, the water supply is mounted above the sink. U.S. 2003/0019031 A1 The electric pump, an electric heater from the prior art would not be needed, the water would flow from the force of gravity down an incline into the sink. The present invention is environmental friendly.

The Parker invention has a storage unit when the sink is operatable, with an easy open handle door to store multiple items such as: first aid equipment, towels, cooking utensils, cleaning products to list a few, which the prior art U.S. Pat. Nos. 6,101,643, 6,173,458 B1 and 2003/0019031 A1 does not provide.

U.S. Pat. Nos. 6,173,458 B1 and 2003/0019031 A1 prior art all lack counter space and essential features when needing to make some preparation at activities or events such as: cook-outs, tail-gate parties, camping trips and construction/work sites.

U.S. Pat. No. 6,827,364 B1 prior art lacks the opening of handle bar to place a roll of paper towels. There is a front storage door on the present invention for additional access. There are two treaded wheels for more endurance and traction.

This invention also solves the problem of saving water by having a time release handle to control water flow and avoid waste.

The benefits of this utility sink is the convenience of having a light-weight, transportable water source and sink when you are outdoors. This invention can be easily folded for storage or transported in trunk of vehicle.

The present invention can be made of multiple materials to give it a sleek style and appearance. The utility cart is mounted on wheels having treads on it's exterior surface for traction on support surface.

OBJECTS AND ADVANTAGES

Accordingly, besides the objects and advantages of the powerless feature of the water flow described in my above patent, several objects and advantages of the present invention are:

A. to provide the use of a sink without needing electricity.

B. to provide for a necessity in the event of a crisis, natural disaster, outdoor event and work sites by having items transported in the utility cart and the additional usage of a sink.

C. the detachability of the sink for easy transport and all the pieces fit into the bowl of sink.

D. the additional work space provided when the lid is placed on the bowl.

E. to provide easy use of an garden hose to draw on an external water supply that is connected to time release handle to control water flow and avoid waste.

F. to provide for additional storage space.

G. to provide easy installation of all parts of sink which you will see in drawings.

Further objects and advantages are the durability, light weight, sleek design and the overall function of the utility sink. This invention provides needs no electrical repairs. Further provision is a towel holder which is used through the retractable handle and a soap dispenser. This sink has the quality control of saving energy and helping our fellow man in need.

Still further objects and advantages will become apparent from a consideration of the ensuing description and drawings.

SUMMARY

In accordance with the present invention a portable utility sink. The main advantage of the invention is to provide a water source, a sink and storage area that can be used in various conditions and needs no electrical power. The invention allows for water to be transported to the sink in water containers by the Individual (s) who has the portable utility sink or by other participants. This makes the sink light weight and easy to transport. Further objective is that a garden hose can be connected to the sink's faucet. The portable utility sink requires low cost maintenance and no electrical repairs. The installation of all parts are quick and simple. The sink, which is detachable for easy transport, sits on the base of the cart. The water source would be housed inside of a funnel spout which would cause the water to flow from the force of gravity. There is a drain that is connected to the hose. The hose is placed inside of the water container that would catch all the dirty water. Besides the handle on the cart being used for moving the unit around it's also snaps open to hold a roll of paper towels.

DRAWINGS

Figures

In the drawings, the invention will be described with the illustration of reference.

DRAWING

Reference Numerals

10. Cart 11. Base
12. Handle with Legs 13. Rubber Stoppers
14. Retractable Handle 15. Cross Bar
15.*a*. Screws 16. Bolt
18. Couples 20. Hinges
22. Wheels 23. Wheel Hubs
24. Removable Sink 25. Lid
26. Faucet 28. Lever
30. Nut 32. Funnel
32.*a*. Fresh Water Container 33. Rubber Support Band
34. Drain Hose 36. Caught Container
38. Latchets 40. Door
40.*a*. Door Handle 40.*b*. Snaps
42. Clamps 44. Soap Holder
46. Bars 48. Carry Bag
49. Zipper 50. Garden Water Hose

DETAILED DESCRIPTION OF THE PREFERRED EMBODIMENT

Figure 1:
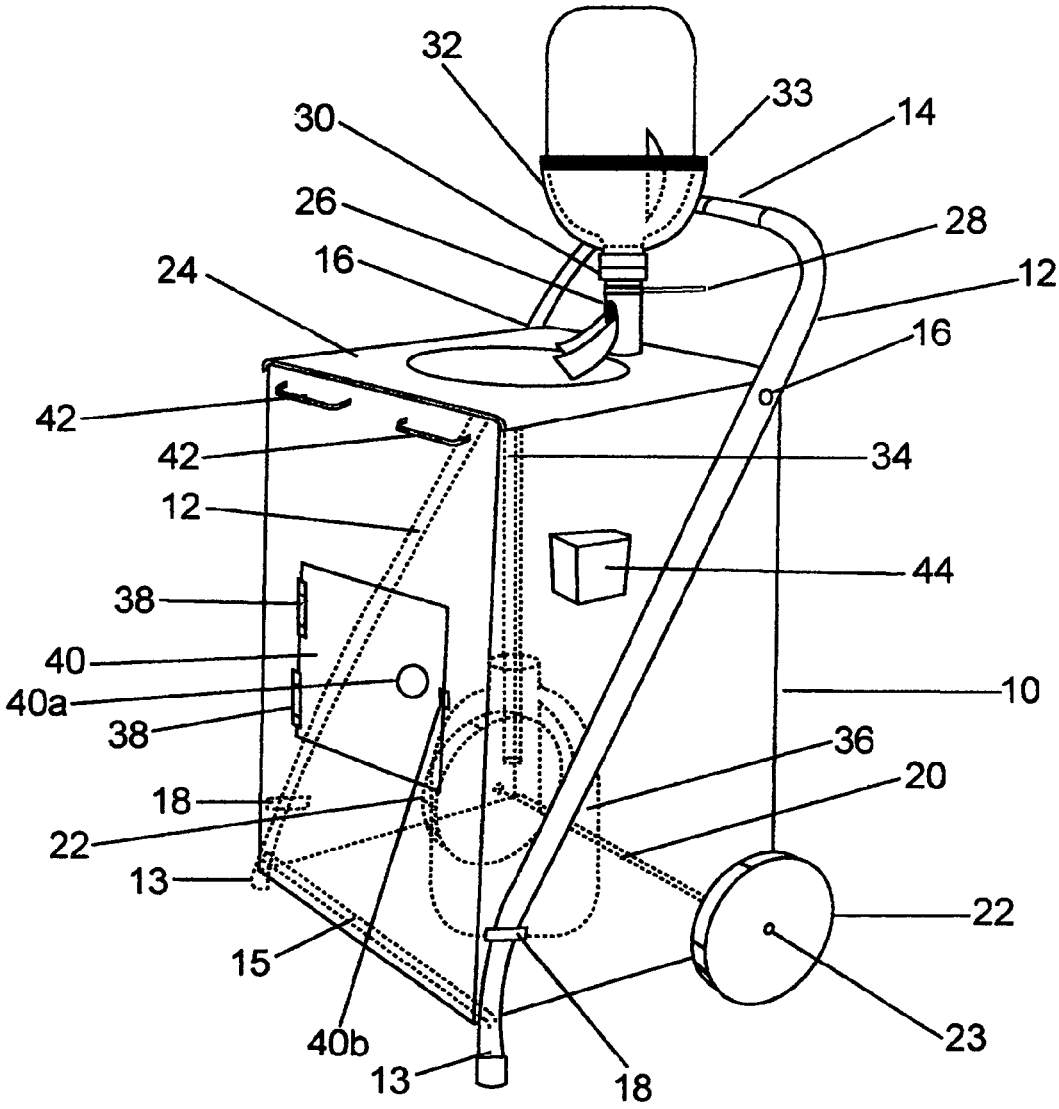
FIG. 1 shows a overall side view of the embodiment of the inventive portable utility cart.

Looking specifically at FIG. 1 it can be seen that a utility cart 10 has been shown with a removable sink 24. The utility cart 10 has one door 40. The door is supported on hinges 38 that allows the door 40 to be open and closed. The door 40 is secured to the cart by the closure snaps 40.*b*. A handle 40.*a*. is secured to the door 40 by pulling or pushing for easy access inside of the utility cart 10.

The utility cart 10 is supported by two wheels 22. They assist with the mobility of the utility cart 10. The two wheels 22 are connected to an axel 20 which maintains the balance on the utility cart 10. The wheels 22 are enjoined to the axel by a wheel hub 23.

Attached to the frame of the utility cart is the handle with legs 12. The front legs invert at the central upright position that allows for a retractable handle 14. The effectiveness of this retractable handle 14 is used to the move the utility cart 10 from various locations. The retractable handle 14 opens and converts to a paper towel holder. Each of the front legs 12 on the utility cart 10 has a rubber stopper 13 when opened maintains an unmovable position, in which it will not roll away. The crossbar 15 is connected to the front legs 12 underneath the base of the utility cart 10. This provides support to the utility cart 10 when it is open.

Figure 2:
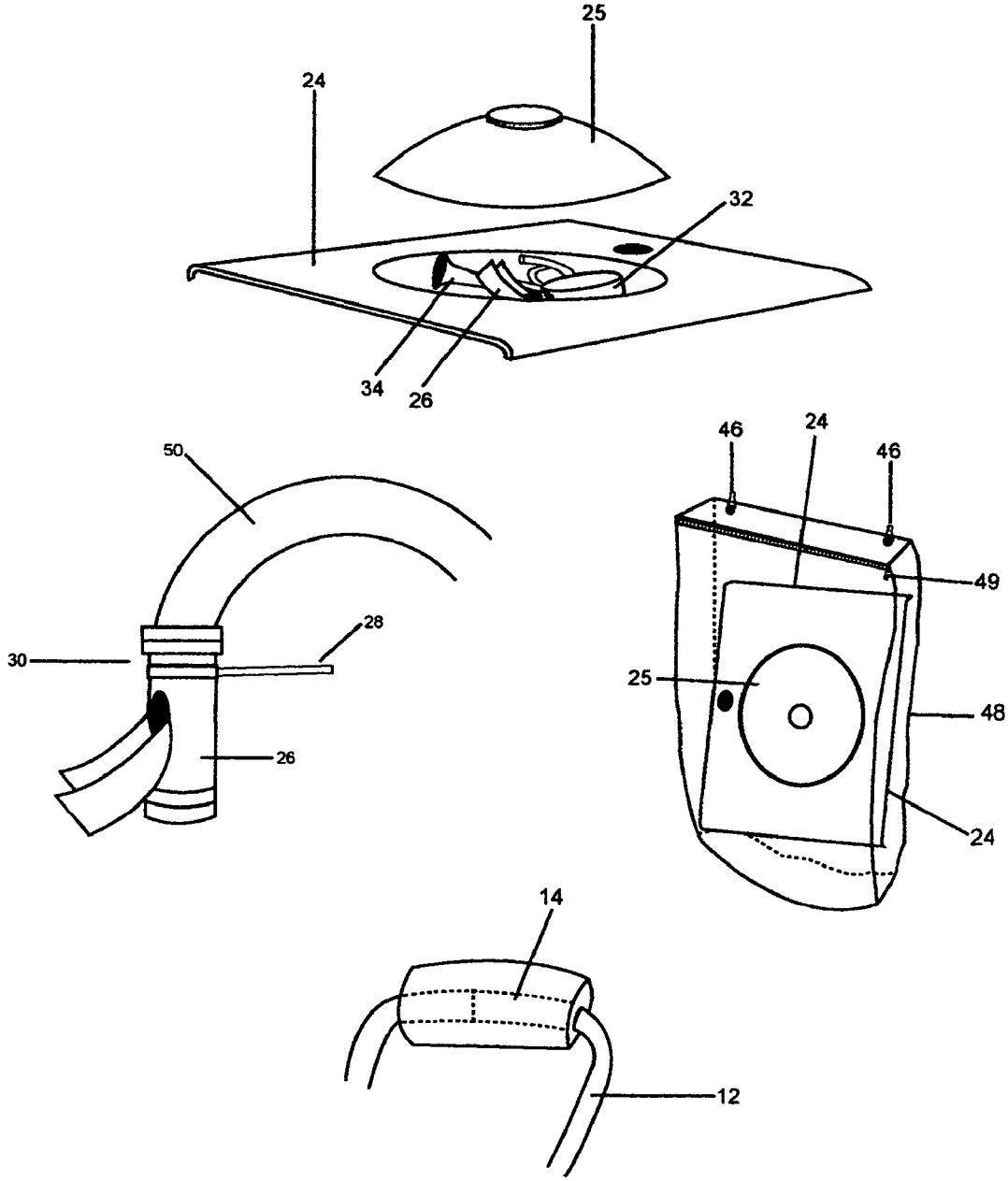
FIG. 2 shows a view of all the portable utility cart features: sink, retractable handle, garden hose and carry bag.
Figure 4:
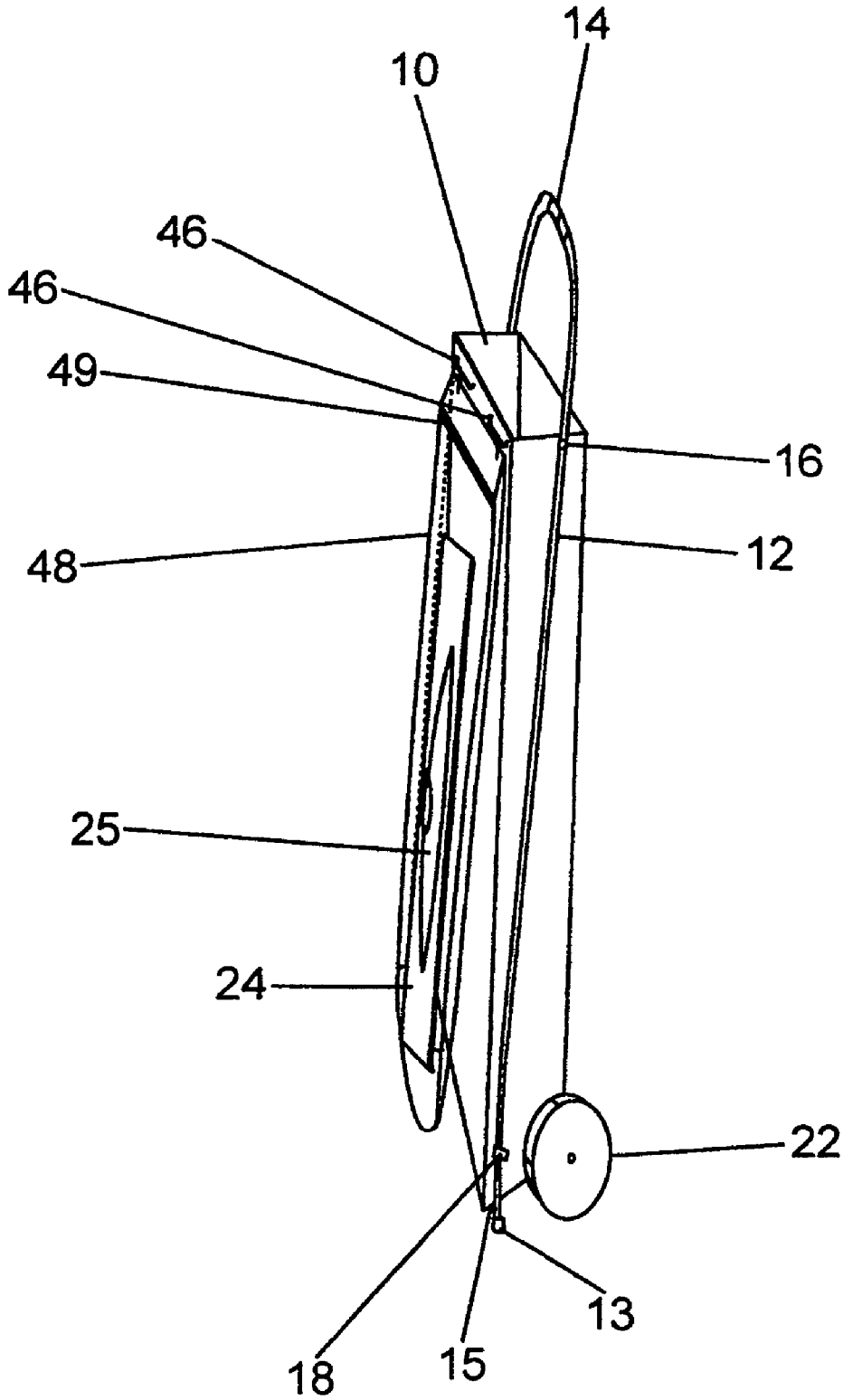
FIG. 4 shows overall side view of the closed portable utility cart.

Looking at FIGS. 1,2 the utility cart 10 has a soap dispenser 44 attached to the right side of the cart. The soap dispenser 44 provides accessibility to hand washing and cleansing of other necessities. FIGS. 2,4 shows the carry bag 48 is transporter for the removable sink 24. The carry bag 48 has a zipper 49 to secure the removable sink 24. The carry bag 48 has two latchets 46 that secure to the clamps 42 when on the utility cart 10.

FIG. 2 shows a garden hose 50 attachment. This can be used instead if the fresh water container 32.*a*. It allows for continual flow of water without changing the fresh water container 32.*a*. The water is release through the moving of the lever 28. The bowl of the removable sink 24 carries the drain hose 34, faucet 26 and the funnel 32. The lid 25 protects and ensure safe transportation of the items. When the lid 25 is on you also have a work area. The drain hose 34 is one piece. The gray water travels downward into the caught container 36. The drain hose 34 can also be extended outside of the utility cart 10 to discharge excess water without the caught container 36.

Figure 3:
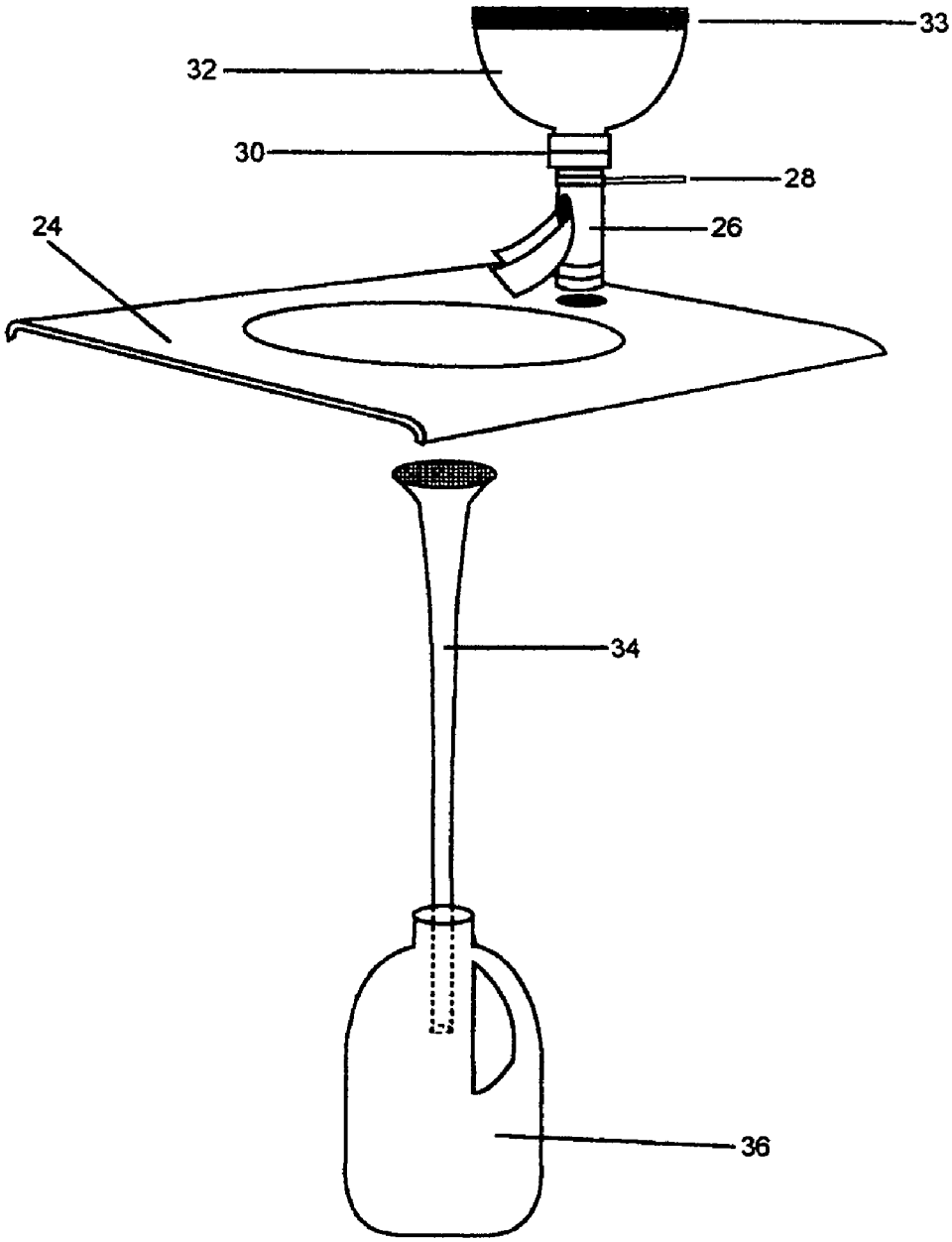
FIG. 3 shows fresh water delivery and drain system.

Looking at FIGS. 1,3 the utility cart 10 has one bowl. Attached to the sink 24 with one faucet 26 connected to the drain hose 34 and caught container 36.

Looking more specifically at FIG. 3 it can be seen that the removable sink 24 and the utility cart 10 are two individual parts. This attachment feature allows for easy storage or transporting to various activities. The funnel 32 screws on top of the faucet 26 to provide a downward flow of the fresh water container 32.*a*. The fresh water container 32.*a*. is nestled inside of the funnel 32.

Looking at FIG. 3 the funnel 32 is being supported together by a nut 30. It is understood that the fresh water container 32.*a*. is secured by a rubber support band 33 mounted inside of the funnel 32. The interior if the funnel 32 is a rubber support band 33 that is attached to maintain water pressure.

FIG. 3 shows the faucet 26 and lever 28 in which the release of water to be determine when the lever 28 is moved from one side to the other. Water is pushed downward through the funnel 32 to the removable sink 24.

FIG. 4 is a drawing of the utility cart collapsible by pivoting the handle with legs 12 to fold up the utility cart 10 in a horizontal dimension. By pulling the handle with legs upward to start collapsing of the front base 11 to the handle with legs 12. Since the front is connected to the rear, upward movement starts. Thus, the utility cart reduces in breadth and width. When opened the action is reversed.

CONCLUSION, RAMIFICATIONS, AND SCOPE

Accordingly, this reader will see that portable utility sink invention has the additional advantages:

- Can be used in any type of settings, natural disasters, construction sites, indoors and outdoors.
- It doesn't need power to function.
- All the parts of the sink are easy to attach, and are pre assembled.
- Due to it's easy storage it is always packed and ready for easy transportability
- Can be made of various colors and materials.

Although the description above contains many specificities, these should not be construed as limiting the scope of the invention but as merely providing illustrations of some of the presently preferred embodiments of this invention. For example, the clamps can have other shapes, such as oval, triangular, etc.; the fresh water container can have other shapes; the hinges can be replaced by couplings, etc.

Thus the scope of the invention should be determined by the appended claims, rather than by the examples given.

What is claimed is:

1. A portable retractable utility cart that has the multiple functions of transporting goods, storage and providing support for a sink, comprising:

a cart having a horizontal rectangular shape with two sides located between a front and a back and being made of durable material, a base of said cart, said base of the cart being closed and a top of the cart being open, said sink being removably positioned over said open top; a crossbar extending across the lower front of the cart to provide support for said cart when said cart is in a use position;

a rear axle mounted horizontally to the back lower base, the end of said axle extending outwardly from each side of said cart, said rear axle having a wheel attached to each end thereof, enabling said cart to be mobile;

a retractable handle attached at a point on the upper rear of each side of said cart, said handle extending above said points, to provide a U-shape that can be opened for receipt of a roll of paper towels, said handle extending downwardly and forwardly from said points to form front legs that provide support for the front of said cart in a use position; said legs engaging a clamp on each side of said cart to stabilize said cart in use position, when said legs are disengaged from said clamps, they may be moved toward the rear of said cart to allow for retraction of said cart;

said sink being in the form of a bowl for receipt of water having a drain and a surrounding work surface that includes a faucet and funnel attached thereto for receiving a water container, said sink being positionable on said open end of said cart when said cart is in a use position.

2. The utility cart of claim 1, wherein said funnel is screwed onto said faucet.

3. The utility cart of claim 1, including rubber stoppers mounted on the terminal end of each front leg.

4. The utility cart of claim 1, including a door in the front of said cart providing access to the interior of said cart.

5. The utility cart of claim 1, including a container positioned on said base to receive waste water.

* * * * *